United States Patent [19]

Wiberg

[11] 4,172,252

[45] Oct. 23, 1979

[54] MONITORING ARRANGEMENT FOR MONITORING A CHANGE FROM A NORMAL CONDITION OF ANY ONE OF A PLURALITY OF CONDITION SENSING DEVICES

[75] Inventor: Leif Wiberg, Stockholm, Sweden

[73] Assignee: Pan Data AB, Stockholm, Sweden

[21] Appl. No.: 806,731

[22] Filed: Jun. 15, 1977

[51] Int. Cl.[2] ..... G08B 21/00

[52] U.S. Cl. ..... 340/525; 324/52; 340/652

[58] Field of Search ..... 340/652, 644, 517, 524, 340/525; 324/52

[56] References Cited

U.S. PATENT DOCUMENTS 3,477,019 11/1969 Hartmann ..... 324/52 X

*Primary Examiner*—John W. Caldwell, Sr.
*Assistant Examiner*—Daniel Myer
*Attorney, Agent, or Firm*—Kinzer, Plyer, Dorn & McEachran

[57] ABSTRACT

A monitoring arrangement for monitoring a change from a normal condition of any one of a plurality of condition sensing devices. It includes a common two conductor circuit connecting the condition sensing devices. A central monitoring apparatus is connected to the common two conductor circuit and supplies current to the circuit. Each of the condition sensing devices includes a device for limiting the amount of current flowing therethrough from the common two conductor circuit; a mechanism to detect and to react to any change from a normal condition being sensed; and a mechanism to interrupt the current to at least all following condition sensing devices in the circuit upon reaction of the condition sensing device to a change in a condition being sensed. An apparatus is formed as part of the central monitoring apparatus for measuring and indicating a magnitude of current being supplied to the common two conductor circuit at any given time.

7 Claims, 6 Drawing Figures

MONITORING ARRANGEMENT FOR MONITORING A CHANGE FROM A NORMAL CONDITION OF ANY ONE OF A PLURALITY OF CONDITION SENSING DEVICES

The present invention relates to a monitoring arrangement for detecting a change in the operational state of one of a plurality of objects, each of which objects has associated therewith a fault-indicating device communicating via a two-wire cable with a central monitoring apparatus, said two-wire cable being common to all said objects.

It is known in fault-indicating systems to use transmitters which vary the frequency of a signal transmitted to the central monitoring apparatus when the state of the object being monitored differs from a predetermined state. Even though this known system has the advantage whereby only two electrical wires are required between the central monitoring apparatus and all the objects being monitored, the devices associated with each object are nevertheless both complicated and expensive, since each monitored object must be capable of sending a specific harmonic or frequency to said central apparatus, in order to be able to ascertain rapidly from said apparatus which of the objects being monitored has changed its state.

By "monitored object" is meant here, for example, a dwelling house which is to be monitored against unlawful entry, a liquid-containing vessel in which the level of liquid is to be monitored, etc.

According to the invention there is provided a particularly simple and reliable arrangement in which each fault-indicating system comprises a standard unit and in which the indication of a change in the state of one of a plurality of monitored objects in the central monitoring apparatus as is given in the form of a change in current, this change in current indicating immediately which object shall be investigated.

To this end, the arrangement described in the introduction is characterised by the fact that each fault-indicating system comprises a circuit which, whilst the object monitored by a respective system remains in a predetermined state, is supplied by the central monitoring apparatus with a substantially constant current; that a control means is arranged to interrupt the supply of current to all subsequent fault-indicating systems when the operational state of said object changes from said predetermined state; and that the central monitoring apparatus comprises means for indicating the magnitude of the current supplied to said cable.

Since the central monitoring apparatus supplies a constant, or substantially constant, current to each of said fault-indicating systems, when the current supply to those fault-indicating systems following a system in which a change in the state of the object monitored thereby is interrupted, there will immediately be a corresponding reduction in the current supplied by the central monitoring apparatus, thereby enabling the object whose state has changed to be quickly identified.

A number of embodiments of the invention will now be described with reference to the accompanying drawings.

Figure 1:
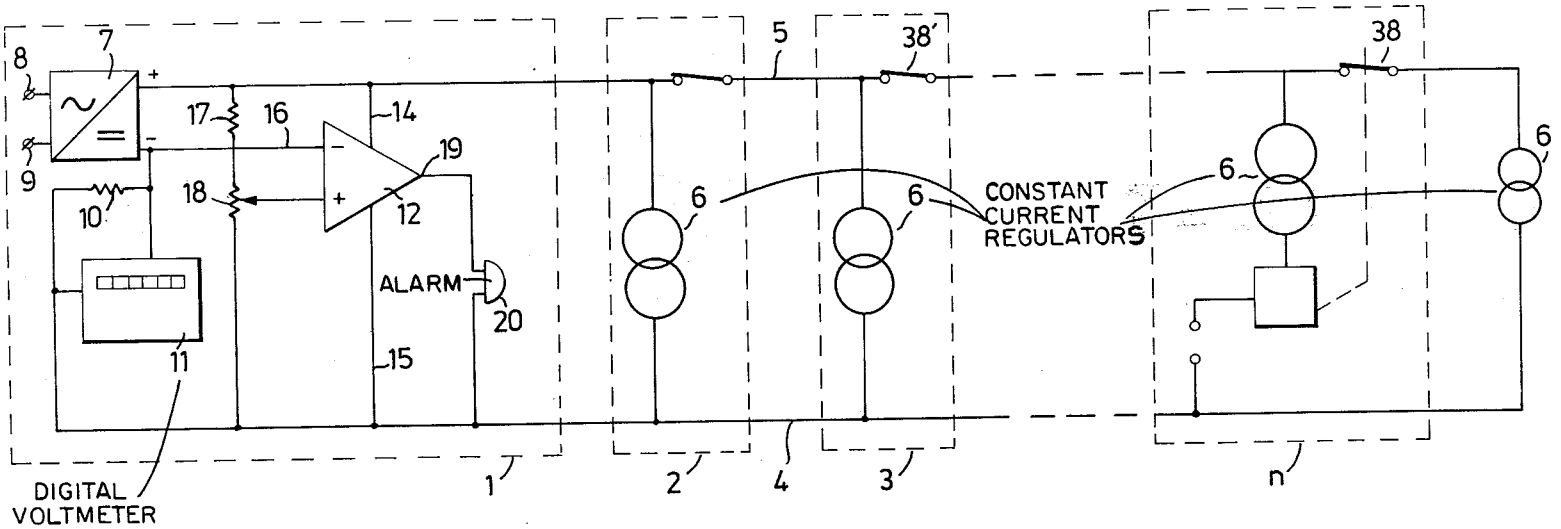
FIG. 1 is a simplified view of a system according to the invention.

FIG. 1 shows a monitoring arrangement according to the invention, having a central monitoring apparatus 1 and a plurality of fault-indicating systems 2, 3 . . . n connected thereto. The fault-indicating systems may, for example, be intended to indicate the occurrence of a burglary or a fire, or the level to which a vessel has been filled, and may be installed, for example, in different buildings at different locations. The fault-indicating systems are connected to the central monitoring apparatus 1, which may be installed in a building separate from those in which said indicating systems are installed, by means of a twin cable having wires 4 and 5, said cable serving all of said fault-indicating systems. The terminal points of the two wires 4, 5 are connected to a terminal circuit comprising a constant-current regulator 6. Each of the fault-indicating systems has one such constant-current regulator 6, an embodiment of which is described below.

The central monitoring apparatus 1 comprises a current supply unit 7 connected, for example, over terminals 8, 9 to an a.c. voltage net, which unit comprises a rectifying device for delivering on its output a d.c. voltage, marked + and − respectively. For indicating the magnitude of the direct current delivered by the unit 7, there is provided between the negative terminal of the unit and the negative wire 4 a shunt resistance 10, across which a digital voltmeter 11 is connected. As will be explained hereinafter, each fault-indicating system 2-n and the terminal circuit consume a constant, or substantially constant current equal to J amps. The shunt resistance 10 is designed so that the digital voltmeter indicates a change of one unit in its display for a change of J amps. When current is consumed by all the fault-indicating systems and the terminal circuits, the digital voltmeter 11 will consequently show a value corresponding to n.J, while, for example, when only the fault-indicating circuits 2 and 3 in FIG. 1 consume current, the digital voltmeter 11 will indicate a value corresponding to 2.J. Thus, as will be explained hereinafter, the arrangement is such that in the event of a fault or a deviation from a predetermined state of a monitored object, indicated, for example, by the circuit 2, all the following fault-indicating circuits, calculated from the central monitoring apparatus to the loop terminal circuit, will be disconnected. This means that current will be consumed only by circuit 2 and the digital voltmeter will indicate a value corresponding to 1 J, which in turn indicates that a deviation from the predetermined state has taken place at the site of the first fault-indicating system of the series, i.e. the fault-indicating system 2.

The illustrated central monitoring apparatus 1 is also provided with a comparator 12 (operational amplifier) which obtains a supply voltage across a line 14 and 15, and the input of which is connected to the negative terminal of the unit 7, across a line 16, and to a voltage divider. The voltage divider comprises a fixed resistance 17 and a variable resistance 18 and is connected between the supply wires 4 and 5. When current supplied by the current-supply unit 7 corresponds to nJ, the signal on the output 19 of the comparator 12 will be zero. When the current supplied by said unit lies beneath the value nJ by an amount equal to at least one current unit J, the comparator 12 will deliver an output voltage which is supplied to an acoustic or optical alarm device 20, thereby obviating the need to constantly monitor the digital voltmeter.

Figure 2:
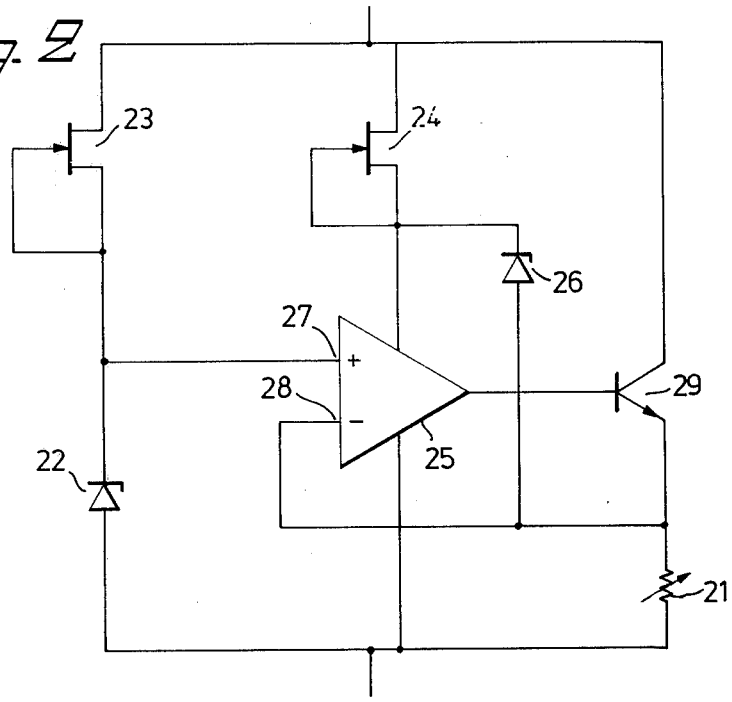
FIG. 2 shows, by way of example, a constant current regulator incorporated in each of the fault-indicating systems shown in FIG. 1.

FIG. 2 illustrates an embodiment of a constant-current regulator 6, one such regulator being incorporated in each of the fault-indicating systems and in the terminal circuit. The constant-current regulator is connected between the current-supply wires 4 and 5 and is provided with an adjustable resistance 21 through which the major part of the constant, or substantially constant, current J passes, said current being characteristic of each fault-indicating system and the terminal circuit. In order for the current J to be held constant, the voltage across the resistance 21 shall be constant and the voltage control is effected by means of a zener diode 22 which is supplied with current over a FET 23 which is connected so as to operate as a current regulator. A further FET 24, which also operates as a current regulator, is arranged to supply an operational amplifier 25 with working current and working voltage which is stabilised by means of a zener diode 26. The current through the zener diode 22 and through the operational amplifier 25 is much smaller than the current through the resistance 21, and hence the dependency of the field effect transistors 23 and 24 on temperature and voltage will not have any significant affect on the total current. The non-inverted input 27 of the amplifier 25 is connected to the reference diode 22, which diode, for example, has a working voltage of 6.8 volts. The inverted input 28 is connected to the resistance 21. Since, as is well known, the amplifier 25 endeavours to maintain the two inputs 27, 28 at equal voltages, the amplifier will control, via a transistor 29, the current through the resistance 21. Since the voltage across the zener diode 22 is held constant, the voltage across the resistance 21 will also be constant, as will also the current through the resistance 21. If, as shown in FIG. 2, the resistance 21 is variable, the system can be readily adjusted to provide the desired constant current.

Figure 3:
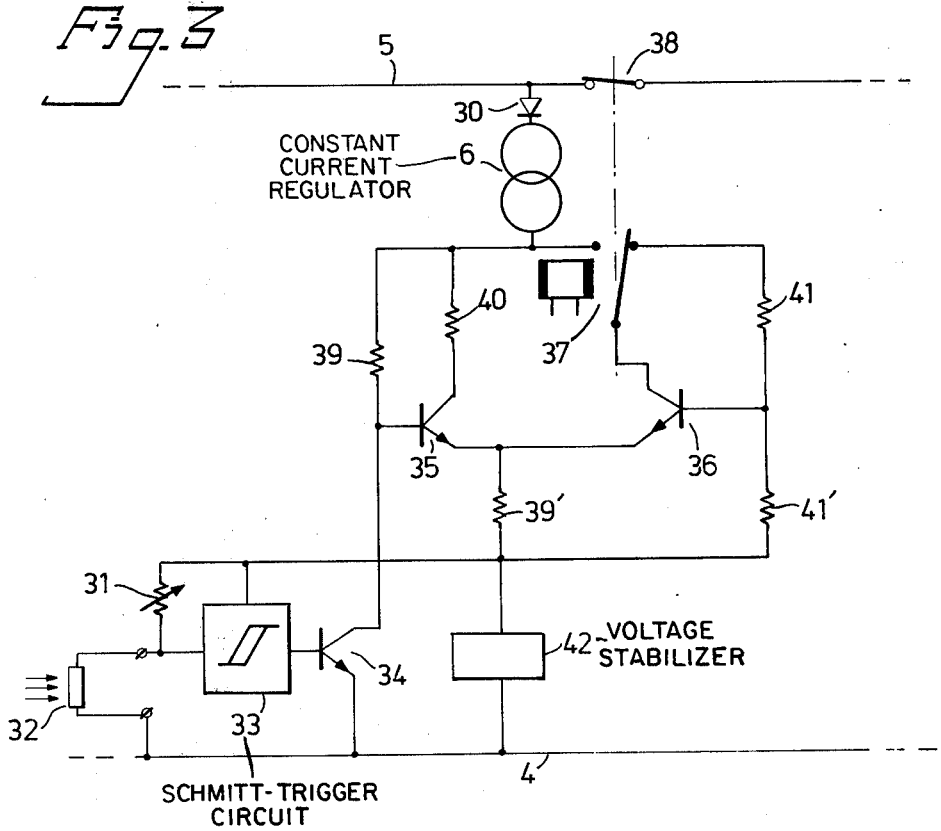
FIG. 3 is an embodiment of a fault-indicating system incorporated in the arrangement shown in FIG. 1.

FIG. 3 illustrates a complete fault-indicating circuit having a constant-current regulator 6 of the described type. To prevent damage to the circuits in the event of wrongly connecting the supply lines, a diode 30 is provided between the supply line 5 and the constant-current regulator.

The fault-indicating circuit, which is to indicate when the state of an object changes from a predetermined state, is connected between the constant-current regulator 6 and the negative supply line 4. It is assumed here that the object to be monitored is a building or a room which must be constantly illuminated and that darkening of the room or building would constitute a change from said predetermined state. The sensing circuit includes a voltage divider having a potentiometer and a light-sensing body 32 whose resistance is changed with a change in light strength. The voltage divider 31, 32 is connected to a Schmitt-trigger 33 forming a voltage-level detector, said level detector controlling, via a transistor 34, a current-mode switch comprising the transistors 35 and 36. When the transistor 34 is conductive, current will flow through the relay winding 37 thereby holding a closing contact 38 closed. The contact 38 is connected in the line 5 and thus breaks the current to circuits located downstream of the contact, i.e. circuits to the right of the contact in FIG. 3. See also FIG. 1 in which this contact 38 is shown. The resistances 39 and 41 in the sensing circuit are identical and much higher than the resistance of the winding 37. The purpose of the resistances 39' and 41' is to provide a suitable working voltage for the transistors 35 and 36 respectively. The circuit also comprises a voltage stabiliser 42 for stabilising the voltage to the level detector 33. In its simplest form, the stabiliser 42 may comprise a zener diode. The potentiometer 31 is used to set the threshold value of the level detector, i.e. the value at which the level detector shall be adjusted in dependence upon the change in resistance of the light-sensitive element 32. When the element 32 ceases to be illuminated, no current will be supplied to the relay winding 37, causing the relay contact 38 to be opened and all following fault-indicating systems and the terminal circuit to be disconnected. A decrease in current corresponding to the number of disconnected circuits will be indicated in the central monitoring apparatus and consequently immediately a fault occurs an indication is given as to where said fault has occurred. Since, in the illustrated case, the contact 38 is arranged in the last fault-indicating system of the chain, only the terminal circuit will be disconnected, said terminal circuit comprising a constant-current regulator 6, and the total current supplied to the supply lines 4 and 5 from the unit 7 will fall by a unit J, i.e. by the current normally consumed by the terminal circuit. Thus, the function of the terminal circuit is merely to provide the requisite decrease in current when the last fault-indicating system begins to operate, to show that a fault has occurred in said last fault-indicating system.

Figure 4:
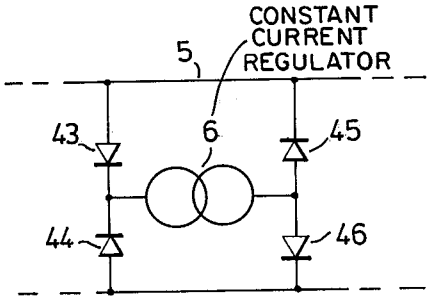
FIG. 4 is a simplified view of a polarity-independent constant-current generator.

FIG. 4 shows how the constant-current regulator 6 can be connected to a diode bridge 43–46 to enable arbitrary connection of the supply line.

Figure 5:
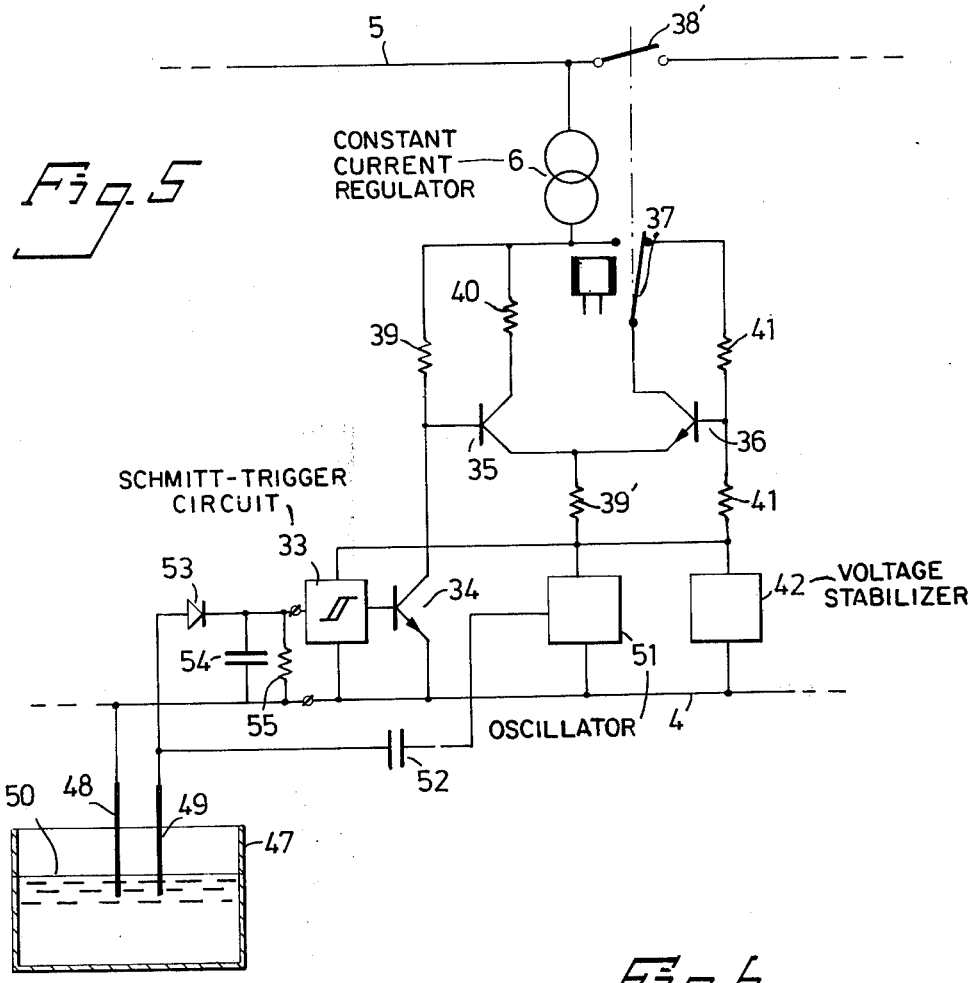
FIG. 5 illustrates a fault-indicating system of the same type as the system shown in FIG. 3 but with a different type of emitter.

FIG. 5 illustrates a fault-identifying circuit for controlling the level of liquid in a tank 47. To this end there is provided two electrodes 48, 49 the lower ends of which shall normally lie above the surface 50 of the liquid. When the surface 50 rises above the ends of the electrodes as shown in FIG. 5, the contact 38' (see FIG. 1) is opened and disconnects all following circuits. The circuit elements described with reference to FIG. 3 have the previously given references and will not be described here. The most important difference between the circuit shown in FIG. 3 and the circuit shown in FIG. 5 resides in the fact that an oscillator 51 is provided. The output signal from the oscillator 51 is supplied across a capacitor 52 to the electrode 49. The capacitor 52 filters out the d.c. voltage component of the output a.c. voltage, which may comprise, for example, a square wave or a sine wave, thereby avoiding polarization. The a.c. voltage is rectified by a rectifier 53 and charges a capacitor 54.

When there is no liquid between the electrode tips, the apparatus is in its predetermined state and the contacts 38' shall thus be closed. In order for the contact 38' in the illustrated circuit to be closed in the determined state, it is necessary for the level detector 33 to be actuated and the transistor 34 to conduct current. When the transistor 34 conducts current, the transistor 35 is cut off and the transistor 36 is conductive, current passing through the relay winding 37 and the contact 38' being held closed. When the level of liquid in tank 47 increases so that the tips of the electrodes 48, 49 are covered by the electrically conductive liquid in the tank, there is formed a voltage divider comprising the internal resistance of the oscillator 51 and the resistance between the electrode tips, the voltage on the diode 53 and the capacitor 54 falling. The capacitor 54 is discharged across a resistance 55 and when the input voltage to the level detector 33 has fallen to a specific value, the level detector 33 changes its state. The transistor 34 is cut off, the transistor 35 becomes conductive and the transistor 36 is cut off, the relay winding 37 being demagnetised and the contact 38' being opened so as to give an alarm.

Figure 6:
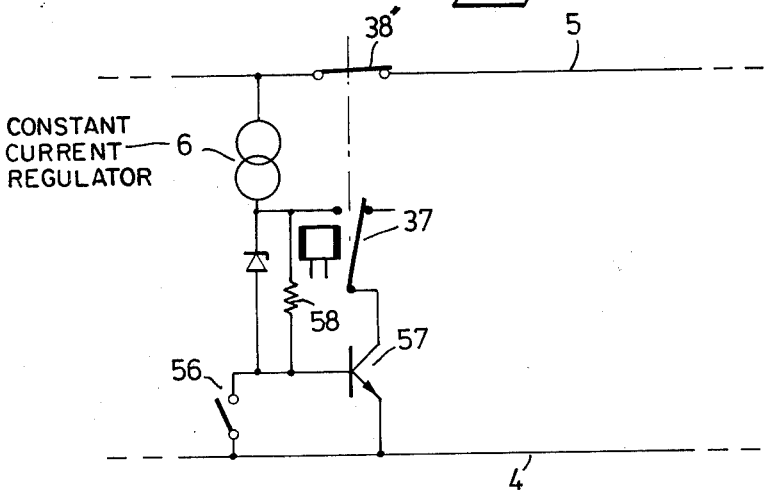
FIG. 6 illustrates a further fault-indicating circuit.

A further embodiment of a fault-indicating system is shown in FIG. 6. In this embodiment, the sensing element comprises a contact 56 which is arranged to close in the event, for example, of a fire in the building or room being monitored. In the normal state of the system of FIG. 6, the constant-current generator 6 is supplied with current through the relay winding 37 as a result of current from the transistor 57. The resistance 58 has a substantially higher resistance than the relay winding 37. When the contact 56 is closed, current will pass through the resistance 58 and across the contact 56 instead of to the base of the transistor 57, whereupon the transistor is cut off and the current through the relay winding 37 is interrupted, the contact 38' being opened. When the contact 38' is opened, all following circuits are disconnected and a fault is indicated on the digital voltmeter 11 and an alarm given from the alarm device 20.

Although a plurality of different circuits and different elements for sensing the predetermined, normal state of an object has been shown and illustrated, it will be obvious to one of normal skill in the art that many modifications can be made within the scope of the invention.

Although the relay winding has been described as a quiescent current winding, arranged to hold an associated contact closed in the normal state of a fault-indicating system, it is also possible, of course, to first magnetize the winding when a fault or a deviation from said normal state is detected.

What we claim is:

1. A monitoring arrangement for monitoring a change from a normal condition of any one of a plurality of condition sensing devices including:

a common two conductor circuit connecting said condition sensing devices, a central monitoring apparatus connected to said common two conductor circuit and supplying current to said circuit, each of said condition sensing devices including:

(a) means to limit the amount of current flowing therethrough from said common two conductor circuit, (b) means to detect and react to any change from a normal condition being sensed, and (c) means to interrupt the current to at least all following condition sensing devices in said circuit upon reaction of the condition sensing device to a change in a condition being sensed, and means formed as a part of said central monitoring apparatus for measuring and indicating the magnitude of current being supplied to said common two conductor circuit at any given time.

2. The monitoring arrangement of claim 1 in which said means to limit the amount of current flowing through each condition sensing device limits the current to essentially equal values for each sensing device.

3. The monitoring arrangement of claim 1 in which said means to interrupt the current to at least all following condition sensing devices in said circuit includes a switch located in one conductor of said circuit with the switch movable between circuit closing and circuit interrupting positions by the operation of a relay.

4. The monitoring arrangement of claim 3 in which the operation of said relay is controlled by said means to detect and react to any change from a normal condition being sensed.

5. The monitoring arrangement of claim 4 in which said relay is magnetized when said means to detect and react to any change from a normal condition being sensed detects a normal condition.

6. The monitoring arrangement of claim 4 in which said relay is de-magnetized when said means to detect and react to any change from a normal condition being sensed detects a normal condition.

7. The monitoring arrangement of claim 6 in which said means to detect and react to any change from a normal condition being sensed changed its electrical resistance in response to a change in the condition being sensed.

* * * * *